US006821478B2

(12) United States Patent
Weber

(10) Patent No.: US 6,821,478 B2
(45) Date of Patent: Nov. 23, 2004

(54) METHOD AND DEVICE FOR SINTERING ALUMINUM BASED SINTERED PARTS

(75) Inventor: Hartmut Weber, Herrenberg (DE)

(73) Assignee: Eisenmann Maschinenbau KG (DE)

( * ) Notice: Subject to any disclaimer, the term of this patent is extended or adjusted under 35 U.S.C. 154(b) by 138 days.

(21) Appl. No.: 10/312,652

(22) PCT Filed: May 12, 2001

(86) PCT No.: PCT/EP01/05443

§ 371 (c)(1),
(2), (4) Date: Dec. 26, 2002

(87) PCT Pub. No.: WO02/00377

PCT Pub. Date: Jan. 3, 2002

(65) Prior Publication Data

US 2003/0143098 A1 Jul. 31, 2003

(30) Foreign Application Priority Data

Jun. 28, 2000 (DE) ..... 100 30 5148

(51) Int. Cl.[7] ..... B22F 3/12

(52) U.S. Cl. ..... 419/25; 419/36; 419/57; 266/252; 266/257; 266/259

(58) Field of Search ..... 419/25, 36, 57; 266/251, 252, 257, 259

(56) References Cited

U.S. PATENT DOCUMENTS 3,232,754 A 2/1966 Storchheim ..... 75/214
4,113,240 A * 9/1978 Klein ..... 266/252
4,373,706 A * 2/1983 Elhaus et al. ..... 266/252
4,401,297 A * 8/1983 Doi et al. ..... 266/252
4,661,315 A * 4/1987 Wiech, Jr. ..... 419/10
5,048,801 A * 9/1991 Johnson et al. ..... 266/256
5,147,083 A 9/1992 Halstead et al. ..... 228/42
5,289,968 A 3/1994 Maeda et al. ..... 228/223
5,292,358 A 3/1994 Miura et al. ..... 75/249
5,842,109 A * 11/1998 Akpan et al. ..... 419/38
6,123,895 A * 9/2000 Yamagata et al. ..... 419/13

FOREIGN PATENT DOCUMENTS

GB 1 115 465 5/1968

OTHER PUBLICATIONS

"Metals Handbook vol. 7—Powder Metallurgy." American Society for Metals, Ohio, 1984.

* cited by examiner

*Primary Examiner*—Ngoclan T. Mai
(74) *Attorney, Agent, or Firm*—Factor & Lake

(57) ABSTRACT

The invention relates to a method for sintering aluminium-based sintered parts which are, initially, guided with the aid of a transport system T through a de-binding area (3) before being guided through followed by a sintering area (2) and finally being guided through a cooling area (4). Inert gas atmosphere prevails in the sintering area (2), provided with an oxygen content, corresponding to a thawing point of, maximum, 40° C. The sintered parts (23) are heated to the required sintering temperature of 560–620° C., by means of convection, whereby the inert gas atmosphere is accordingly heated, flowing around said sintered parts in a corresponding manner.

10 Claims, 2 Drawing Sheets

METHOD AND DEVICE FOR SINTERING ALUMINUM BASED SINTERED PARTS

The invention relates to a method for sintering aluminium-based sintered parts whereby the following steps are carried out in separate atmospheres in spatially separate areas in each case:

a) the parts to be sintered are de-bindered;

b) the parts to be sintered are heated to sintering temperature and maintained at this temperature for a certain time;

c) the sintered parts are cooled in a controlled manner, and to a device for sintering aluminium-based sintered parts comprising a) a de-bindering area in which the sintered parts are stripped of binding agents by heating;

b) a sintering area in which the parts to be sintered are subjected to a sintering process by heating to sintering temperature, which area has suitable heating arrangements for this purpose;

c) a cooling area in which the sintered parts can be cooled in a controlled manner after the sintering process;

d) a transport system which continuously conveys the parts for sintering through the different areas;

e) airlocks which keep the atmospheres of the different areas separate and through which the parts for sintering must pass on leaving a particular area.

In view of the positive properties inherent in aluminium the sintering of this metal is gaining increasing importance in very diverse technical fields, but in particular in motor vehicle construction. In the last-mentioned field weight-saving, which is associated with the use of aluminium, plays an especially important part.

In general, pure aluminium powder is not processed; rather, powder mixtures or alloyed powders containing in particular silicon as an additive are preferably used. All powders containing aluminium as an important constituent are here collectively called "aluminium-based"; such powders are in danger of forming oxides during sintering. Sintered aluminium parts with a relatively high silicon content are especially desired. However, with increasing silicon content the sintering process becomes more difficult. A further difficulty in sintering aluminium-based powders is that they require a higher content of binding agents during the pressing process. Whereas such binding agents, which are used at the same time as lubricants for the pressing tool, represent a content of approx. 0.7 to 1.0 weight percent in the sintering of iron, for example, binding agents representing a weight percentage of approx. 1.0 to 1.5 must be added when sintering aluminium. These binding agents must be completely removed before the sintering process. Altogether, the requirements for accuracy, reproducibility and homogeneity of temperature distribution are far more critical when sintering aluminium-based powder than when sintering other powders, in particular iron. For this reason sintered aluminium parts have not yet come into use in all cases where this would in itself be desirable.

A method and a device of the above-mentioned type are described in DE-PS 197 19 203. Although the title of this document refers to a sintering process for pressed metal powder parts, which linguistically would also include aluminium powder, this method and device are in fact intended only for sintering iron-based powders since the fast cooling of the sintered parts below the "martensite start line" claimed in that document is only conceivable for such powders.

It is the object of the present invention to specify a method of the above-mentioned type whereby high-grade aluminium-based sintered parts can be manufactured.

This object is achieved according to the invention in that in process step b) an inert gas the oxygen content of which corresponds to a dew point not higher than −40° C. is used as the atmosphere, and in that the parts for sintering are heated to a sintering temperature of 560–620° C. through circulation of the correspondingly heated inert gas.

The invention is therefore based on a recognition of two factors: because an upper limit is placed on the oxygen content of the inert atmosphere it is ensured that no undesired oxides which would detrimentally influence the product of sintering can form in the sintering process; and because, unlike the subject of the above-mentioned DE-PS 197 19 203, the parts for sintering are heated not by radiant heat but by convection heat, for which purpose the high-purity inert gas is impelled in a circulating current, the heating of the parts for sintering has a homogeneity which could not otherwise be achieved. The desired high quality of the sintered products results only from the combination of these features.

Nitrogen is preferably used as the inert gas. This gas is commercially obtainable at the required purity and is very much cheaper than noble gases which in principle could also be used.

A further object of the present invention is so to configure a device of the above-mentioned type that it is suitable for the manufacture of high-grade aluminium-based sintered parts.

This object is achieved according to the invention in that f) the atmosphere in the sintering area is formed by an inert gas the oxygen content of which corresponds to a dew point not higher than −40° C.;

g) the sintering area comprises at least one heating arrangement for the parts for sintering which includes indirectly heated heat exchanging surfaces, a fan and an air guidance arrangement such that a circulating flow of the inert gas around the parts for sintering can be induced.

The purpose of these features and the advantages attainable thereby coincide with what was said above regarding the method according to the invention.

The advantages of the embodiment specified in claims 4 and 5 have also already been indicated above with reference to the method according to the invention.

The sintering area of a sintering device must be of a length which corresponds to the time needed for sintering at the selected transport speed. In general, it is recommended that a relatively long sintering area comprises a plurality of zones separated by dividing walls, each of which zones has a heating arrangement with heat exchanging surfaces, a fan and an air guidance arrangement. In this way uniformly defined gas flow characteristics can be established at all points even in the case of relatively long sintering areas.

In particular in the heating zone of the sintering area the temperature of the inert gas differs between zones of the sintering area located successively in the direction of movement.

The embodiment of the invention in which the gas circulation around the parts for sintering differs in successive zones of the sintering area in the direction of movement yields especially good sintering results because of the highly homogenous temperature profile. For example, the parts for sintering can be exposed to a gas flow in one case from below to above, in another case from above the below, in another case to a flow rotating clockwise in the direction of movement and in another case to a gas flow rotating anti-clockwise in the direction of movement.

It is also advantageous if a nozzle plate is provided, by means of which the circulating inert gas is directed against the parts for sintering. The gas flow in the area of the parts for sintering and therefore the heating undergone by said parts can thereby be further homogenised.

As mentioned above, careful maintenance of the purity of the atmosphere in the sintering area plays an especially important part. Accordingly, special attention must be paid to gas sealing during the transfer of the parts for sintering to and from the sintering area. It is especially preferred if the doors of the airlocks adjacent the inlet and/or the outlet of the sintering area are closable in a not completely sealed manner and if the inert gas in the sintering area is at a pressure above atmospheric. Through the intentional "leakage" in the door of the airlock adjacent the sintering area a flushing current of inert gas from the sintering area into the airlock concerned is constantly maintained, by which flow, firstly, the interior of the airlock is flushed and, secondly, penetration of external atmosphere from the airlock into the sintering area is prevented.

An embodiment of the invention is explained in more detail below with reference to the drawings, in which.

Figure 1:
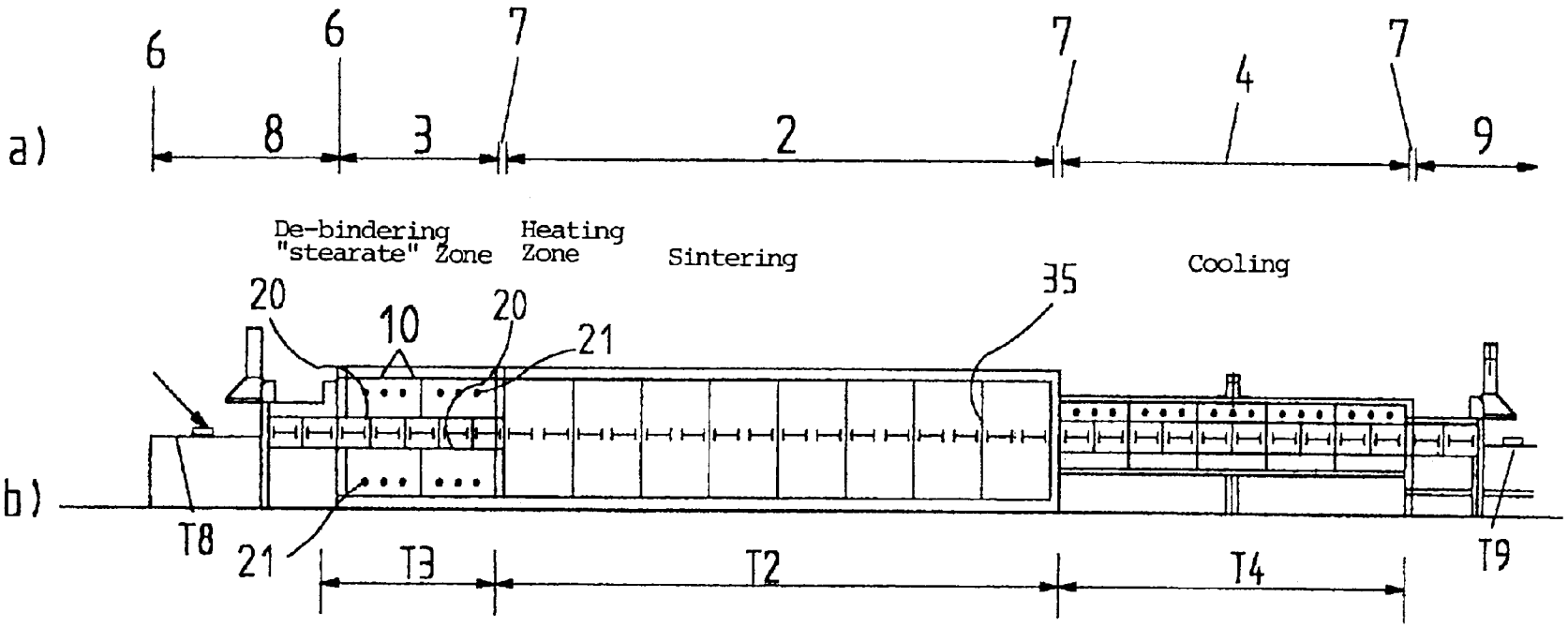
FIG. 1 represents schematically a sintering furnace for sintering aluminium-based sintered parts.

FIG. 1*b* shows in vertical section a sintering furnace intended for sintering aluminium-based sintered parts. The whole sintering furnace is subdivided into different zones or areas which are schematically shown in FIG. 1*a* in correlation to FIG. 1*b*. The parts 23 to be sintered (cf. FIG. 2) are moved continuously through the sintering furnace by means of a transport system T from left to right in the drawing. The sintering furnace contains—seen successively in the transport direction—an intake area 8, a de-bindering area 3, a sintering area 2, a cooling area 4 and an outlet area 9. Associated with each of these areas 2, 3, 4, 8, 9 of the sintering furnace is a separately driveable and controllable conveyor T2 to T9, which together form the above-mentioned conveyor system T.

To isolate the atmospheres in the areas 3, 2, 4 and 9 airlocks 7 each having two mechanical doors 6 are arranged between these areas. These doors 6 are arranged in each case in a shaft at the ends of the corresponding area 3, 2, 4, 9 and are preferably vertically movable, a separately activatable and controllable conveyor (not illustrated in the drawings) likewise being associated with each airlock 7.

Details of the airlocks 7 can be seen in FIG. 4 of the above-mentioned DE-PS 197 19 203.

The de-bindering area 3 which precedes the sintering area 2 in the transport direction is configured as a box-type furnace, i.e. located above and below the travel path of the parts to be sintered are dividing walls 20 which are brought up to temperature by electric heating bars 21 or the like and which heat the parts for sintering conveyed past them substantially by radiant heat, expelling the binding agent therefrom.

Whereas in the sintering furnace for sintering iron powder parts described in DE-PS 197 19 203.3 the sintering area also operates with radiant heat, the sintering area 2 of the present sintering furnace differs therefrom in a manner which will now be described with reference to FIG. 2.

Figure 2:
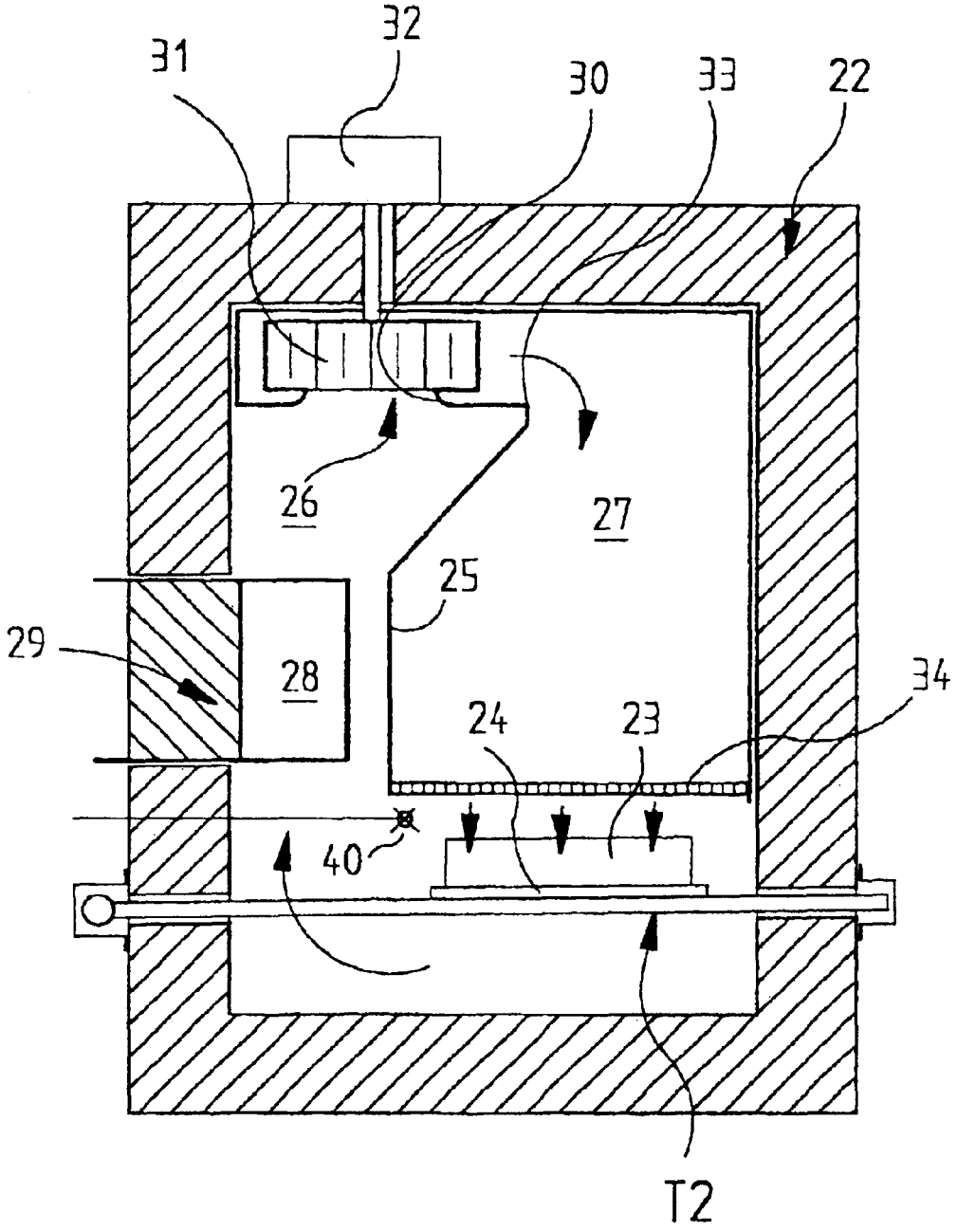
FIG. 2 shows a cross-section through the sintering furnace of FIG. 1 in the area of the sintering zone on an enlarged scale.

FIG. 2 shows a section perpendicular to the direction of movement of the parts for sintering in the area of the sintering zone 2. The housing 22, which is provided with insulation, is well sealed at all points at which penetration by air from the external atmosphere or escape of gases from the internal atmosphere would be possible. Shown in the lower area of the housing 22 is the transport system T2, the exact construction of which is deliberately left open. It is distinguished by good gas permeability in the vertical direction; roller or link conveyor systems, for example, are especially suitable. By means of the transport system T2 the parts 23 for sintering are transported perpendicularly to the plane of projection of FIG. 2, in the example illustrated on a carrier plate 24 which should itself ideally have good permeability in the vertical direction.

The area of the interior of the housing 22 located above the parts 23 for sintering is subdivided into two chambers 26 and 27 by means of a dividing wall 25 disposed parallel to the direction of movement of the parts 23 for sintering and substantially vertical. Located in the chamber on the left-hand side of FIG. 2 are the heat exchanging surfaces 28 of an indirect heating unit 29 which, for example, can be electrically operated. At the upper end of the chamber 26 are located air deflector plates with a central aperture 30 representing the intake aperture of a fan 31. The fan 31 is driven by a motor 32 mounted on the upper face of the housing 22.

The outlet side of the fan 31 is connected to the right-hand chamber 27 in FIG. 2 of the interior of the housing 22 via an aperture 33. This chamber 27 is terminated at its lower end, shortly above the parts 23 for sintering, by a nozzle plate 34.

As can be seen in particular in FIG. 1*b*, the whole sintering area 2 contains a plurality of identical sintering zones constructed in the above-described manner and separated by dividing walls 35. The dividing walls 35 contain substantially only apertures which allow just enough clearance for the parts 23 for sintering to pass through them.

The cooling area 4 is configured in substantially the same manner as described in DE-PS 197 19 203.3. The manner in which the sintered parts are tempered and cooled in a controlled manner in this area is not of interest in the present context. This area is represented in the drawing by a kind of box-type or "muffle" furnace of similar construction to that used in the de-bindering zone 3.

The above-described sintering furnace operates as follows:

In the intake area 8 pressed parts 23 for sintering are placed on the conveyor system T8, are moved by the latter via a single door 6 into the de-bindering zone 3 where they are taken over by the conveyor system T3. By means of the radiant heat emitted by the heated dividing walls 20 the binding agents are expelled from the parts 23 to be sintered and are substantially removed. Because all the internal faces of the de-bindering zone 3 are hot there is no danger of "sooting" by precipitated binding agent. The parts 23 to be sintered pass singly or in small groups of parts 23 located side-by side and/or one above another through the first door of the airlock 7, which is located between the de-bindering area 3 and the sintering area 2, into the intermediate chamber between the two doors of this airlock 7. As this happens the second door of this airlock 7 leading to the sintering area 2 remains closed. Alternatively, it is possible to leave this second door open with a narrow gap and to operate the interior of the sintering area 2 of the sintering furnace 1 at a certain pressure above atmospheric. In that case the gas atmosphere prevailing there, which will be discussed in more detail below, can leak continuously from the sintering area 2 into the intermediate chamber between the two doors of the airlock 7 and flush this intermediate chamber.

After the group of parts 23 to be sintered has entered the airlock 7 the first door leading to the de-bindering zone 3 is closed and the intermediate chamber of the airlock 7 is flushed and/or evacuated. As mentioned above, the parts 23 for sintering are conveyed by a separate transport system T7, the speed of which can differ from the speed in the other areas of the sintering furnace in order to keep the total plant short.

After a certain sojourn time inside the airlock 7 the door of the airlock 7 adjacent the sintering area 2 opens. The parts 23 for sintering are now transferred to the conveyor system T2 and transferred by the latter into a heating zone which extends, for example, through the first three zones of the sintering area 2. In the further zones of the sintering area 2 the actual sintering takes place at a temperature between 560 and 620° C.

The temperature of the gas present in the individual zones is in each case monitored by means of a temperature sensor 40 (cf. FIG. 4) arranged in the vicinity of the travel path of the parts 23 for sintering, which temperature sensor activates a heating unit 29 via a control loop.

As already noted, all the zones of the sintering area 2 are constructed substantially in the manner illustrated in FIG. 2 and are filled with high-purity nitrogen as the inert atmosphere. The oxygen content of this inert atmosphere must correspond to a dew point not exceeding −40° C. In each zone of the sintering area 2 a circulating flow of the nitrogen atmosphere is maintained by means of a fan 31, which flow, emerging from below in the area of the left-hand chamber 26, is directed in each case past the heat exchanging surfaces 28 of the heating unit 29 through the chamber 26 to the fan 31, from there into the chamber 27 and through the nozzle plate 34 on to the parts 23 for sintering. These hot nitrogen gases then flow around the parts 23, pass through the carrier plate 24 and the transport system T2 and from there are conducted back to the heating unit 29, with which the cycle is closed.

Slight leakage losses of the inert atmosphere inside the zones of the sintering area 2 are compensated by a corresponding supply of fresh gas. The temperature at the intake of the heating unit 29 should differ as little as possible from the temperature at the outlet of the heating unit 29. This is equivalent to saying that the circulating nitrogen gases in the interior of the housing 22 are everywhere at substantially the same temperature.

To further improve the uniformity of the heating of the parts 23 for sintering it is possible to alternate the flow direction of the nitrogen gases in the individual zones of the sintering area 2. In particular it is conceivable to cause the flow in the area of the parts 23 for sintering to be directed alternately from above to below and from below to above.

At the end of the sintering area 2 the sintered parts 23 pass through the airlock 7 located between the sintering area 2 and the cooling area 4 and including two doors, the same processes taking place in an analogous manner to that explained above for the airlock 7 located between the de-bindering area 3 and the sintering area 2. In the cooling area 4 the finished, sintered parts are cooled in a controlled manner to a temperature at which the sintered parts 23 emerge from the cooling area 4 via a further airlock 7 and finally, in the outlet area 9, can be removed from the conveyor system T9 or transported away to a different location.

What is claimed is:

1. A process for sintering aluminium-based sintered parts in which the following steps are carried out in separate atmospheres and in spatially separate areas in each case:

a) de-bindering the parts to be sintered;

b) heating the parts to be sintered to sintering temperature and maintaining at sintering temperature for a certain time;

c) cooling the sintered parts in a controlled manner, characterised in that in process step b) an inert gas the oxygen content of which corresponds to a dew point not higher than −40° C. is used as the atmosphere, and in that the parts (23) for sintering are heated to a sintering temperature of 560 to 620° C. by circulation of the correspondingly heated inert gas.

2. A method according to claim 1, characterised in that nitrogen is used as the inert gas.

3. A device for sintering aluminium-based sintered parts, comprising a) a de-bindering area in which the parts to be sintered are stripped of binding agents by heating;

b) a sintering area (2) in which the parts (23) to be sintered are subjected to a sintering process by heating to sintering temperature, which area has suitable heating arrangements for this purpose;

c) a cooling area in which the sintered parts can be cooled in a controlled manner after the sintering process;

d) a transport system which continuously conveys the parts for sintering through the different areas;

e) airlocks which keep the atmospheres of the different areas separate and through which the parts for sintering must pass on leaving a particular area, characterised in that f) the atmosphere in the sintering area (2) is formed by an inert gas the oxygen content of which corresponds to a dew point not higher than −40° C.;

g) the sintering area (2) has at least one heating arrangement for the parts (23) for sintering which includes indirectly heated heat exchanging surfaces (28), a fan (31) and an air guidance arrangement (25) such that a circulating flow of the inert gas around the parts (23) for sintering can be induced.

4. A device according to claim 3, characterised in that the inert gas is nitrogen.

5. A device according to claim 3 or 4, characterised in that the inert gas is at a temperature of 560 to 620° C.

6. A device according to one of claims 2 to 5, characterised in that the sintering area (2) has a plurality of zones separated by dividing walls (35), each of which zones includes a heating arrangement with heat exchanging surfaces (28), a fan (31) and an air guidance arrangement (25).

7. A device according to claim 6, characterised in that the temperature of the inert gas differs between zones of the sintering area (2) located successively in the direction of movement.

8. A device according to claim 6 or 7, characterised in that the gas flow around the parts (23) for sintering differs between zones of the sintering area (2) located successively in the direction of movement.

9. A device according to one of claims 3 to 8, characterised in that a nozzle plate (34) by means of which the circulating inert gas is directed against the parts (23) for sintering is provided.

10. A device according to one of claims 3 to 9, characterised in that the doors of the airlocks (7) adjacent the intake and/or the outlet of the sintering area (2) are closable in a not completely sealed manner and the inert gases are at a pressure above atmospheric in the sintering area (2).

* * * * *